United States Patent [19]

Rammler et al.

[11] 4,038,045

[45] July 26, 1977

[54] PROCESS FOR DEGASIFYING FINE-GRAINED FUELS

[75] Inventors: Roland Rammler, Konigstein; Johann Grosse-Heitmeyer, Frankfurt am Main; Hans Sommers; Heinz Bathke, both of Essen, all of Germany

[73] Assignees: Metallgesellschaft Aktiengesellschaft, Frankfurt am Main; Ruhrgas Aktiengesellschaft, Essen, both of Germany

[21] Appl. No.: 675,011

[22] Filed: Apr. 8, 1976

[30] Foreign Application Priority Data

June 23, 1975 Germany ..... 2527852

[51] Int. Cl.[2] ..... C10J 3/12; C10B 49/16

[52] U.S. Cl. ..... 48/197 R; 48/210; 48/DIG. 4; 201/12; 201/20

[58] Field of Search ..... 48/210, 202, 206, 197 R, 48/DIG. 4; 201/3, 12, 20, 31, 33; 208/11

[56] References Cited

U.S. PATENT DOCUMENTS

| | | | |
|---|---|---|---|
| 2,595,338 | 5/1952 | Creelman | 48/210 |
| 2,674,525 | 4/1954 | Garbo et al. | 48/206 |
| 3,655,518 | 4/1972 | Schmalfeld et al. | 201/12 |
| 3,703,442 | 11/1972 | Rammler et al. | 201/12 |

*Primary Examiner*—Robert L. Lindsay, Jr.

*Assistant Examiner*—George C. Yeung

*Attorney, Agent, or Firm*—Burgess, Dinklage & Sprung

[57] ABSTRACT

Fine-grained fuels such as coal are continuously degasified by a process wherein a fine-grained degasified residue is recirculated as a heat-carrying medium and is heated in a pneumatic conveyor line and then fed to a collecting vessel. A first partial stream of the heat-carrying medium is fed through a mixing zone together with the fuel to be subjected to dry distillation. A second partial stream of the heat-carrying medium is fed to a secondary degasification zone together with the mixture comprising the dry distillation residue. Volatile constituents are distilled from the mixture in the mixing zone and the secondary degasification zone and are fed to dust-collecting and condensing means. Degasified residue is recirculated to the pneumatic conveyor line. The ratio of the rate of the second partial stream fed to the secondary gasification zone to the rate of the first partial stream of the degasified residue, which first partial stream is fed to the mixing zone for the dry distillation of the fuel, is between 0.2:1 and 15:1. The second partial stream is mixed with the dry distillation residue before the second partial stream is fed to the secondary degasification zone and degasified residue dust is discharged in a particle size of more than 75% below 0.3 mm.

26 Claims, 3 Drawing Figures

PROCESS FOR DEGASIFYING FINE-GRAINED FUELS

BACKGROUND

This invention relates to a process for continuously degasifying fine-grained fuels, particularly coal, in which a fine-grained degasified residue is recirculated as a heat-carrying medium and is heated in a pneumatic conveyor line and then fed to a collecting vessel, a first partial stream of the heat-carrying medium is fed through a mixing zone together with the fuel to be subjected to dry distillation, a second partial stream of the heat-carrying medium is fed to a secondary degasification zone together with the mixture comprising the dry distillation residue, volatile constituents are distilled from the mixtures in the mixing zone and the secondary degasification zone and are fed to dust-collecting and condensing means, and degasified residue is recirculated to the pneumatic conveyor line.

Some portions of this process are known from Printed German Application No. 1,809,874, German Pat. Nos. 1,909,263 and 2,208,418, and U.S. Pat. Nos. 3,655,518 and 3,703,442. In the known processes, the heat-carrying medium consists either of the residue left after the degasification of the material to be degasified, or of an extraneous material. In the process according to the invention the degasified residue is used as a heat-carrying medium.

SUMMARY

Underlying the present process is the fact that the degasified residue which is recirculated as a heat-carrying medium, i.e., in the degasification of coal the resulting coke, should be reduced in part to dust in the process itself. This will be particularly desirable when the process is to be used for a preliminary degasification of coal for boiler furnaces and the quantitatively predominant degasification product, namely, the fine-grained coke, should be fed to the boiler furnace in the small particle size which is desired without need for an interstage cooling and conventional grinding of the coke.

This is accomplished according to the invention by maintaining the ratio of the rate of the second partial stream fed to the secondary degasification zone to the rate of the first partial stream of the degasified residue, which first partial stream is fed to the mixing zone for the dry distillation of the fuel, is between 0.2:1 and 15:1, the second partial stream is mixed with the dry distillation residue before the second partial stream is fed to the secondary degasification zone, and degasified residue dust is discharged in a particle size of more than 75% below 0.3 mm. As a result of this procedure, a sufficiently large part of the recirculating degasified residue is reduced to dust which can be economically used at elevated temperatures as boiler furnace fuel. The disintegration of the particles is promoted by a sudden heating of the fuel as it contacts the hot heat-carrying medium so that a very rapid degasification results. Another fuel which can be degasified is brown coal. Another size-reducing and grinding action is mechanical and occurs in the circulatory system for the degasified residue, particularly in the pneumatic conveyor line and in the collecting vessel, as a result of the abrasion of the particles which are turbulently agitated relative to each other an the walls of the plant. The degasifield residue discharged as hot dust is a good fuel for power plant boiler furnaces which are to be fired with pulverized fuel. For this reason the degasification process is preferably combined with a power plant process for generating electrical energy.

The degasified residue discharged as dust having a particle size of preferably more than 90% below 0.3 mm is suitably used as boiler furnace fuel. The fuel dust having the desired particle size is desirably recovered from the degasification plant by pneumatic separation, which may be effected in the collecting vessel and/or in the secondary degasification zone.

The degasification process according to the invention is usually carried out in such a manner that the ratio of the rate of the branched-off partial stream which is directly fed to the secondary degasification zone to the rate of the first partial stream fed to the mixing zone as a heat-carrying medium for the dry distillation of the fuel is between 0.3:1 and 10:1. The dry distillation in the mixing zone usually rsults in a mixture which exits at temperatures in the range of 500°–750° C, preferably 550°–650° C. Hot degasified residue used as heat-carrying medium and fuel to be degasified are fed to the mixing zone at a weight ratio between 1:1 and 10:1, preferably between 1.5:1 and 4:1. The hotter the degasified residue from the collecting vessel, the smaller may be the mixing ratio.

For a uniform secondary degasification it is highly important that the mixture of hot degasified residue and fine-grained residue obtained by dry distillation is as homogeneous as possible as it emerges from the mixing zone. To ensure the production of such a homogeneous mixture, hot degasified residue may be fed at the end of the mixing zone between the mixer shafts, or a ring chamber distributor, known per se, may be incorporated in the conduit leading to the secondary degasification zone. A plurality of injection conduits opening into the conduit leading to the secondary degasifier may also be used to add the material from the mixing and dry distillation zone to the degasified residue.

When water vapor, preferably superheated water vapor, is fed into the secondary degasification vessel, degasified residue dust can be removed by pneumatic separation and a partial gasification of the coke may be effected. The partial gasification increases the rate at which gas ia recovered from the secondary degasification vessel.

A mixture of heat-carrying medium and newly formed degasified residue is produced in the mixing zone and is fed to a first secondary degasification vessel, the gaseous and vaporous degasification products are removed through a first conduit, solids from the first secondary degasification vessel are fed to a second secondary degasification vessel having a separate exhaust conduit, and the second partial stream of the degasified residue is branched off from the collecting vessel and also fed to the second secondary degasification vessel.

DESCRIPTION OF THE DRAWING

Embodiments of the process according to the invention will be explained with reference to the drawing, in which.

DESCRIPTION

Figure 1:
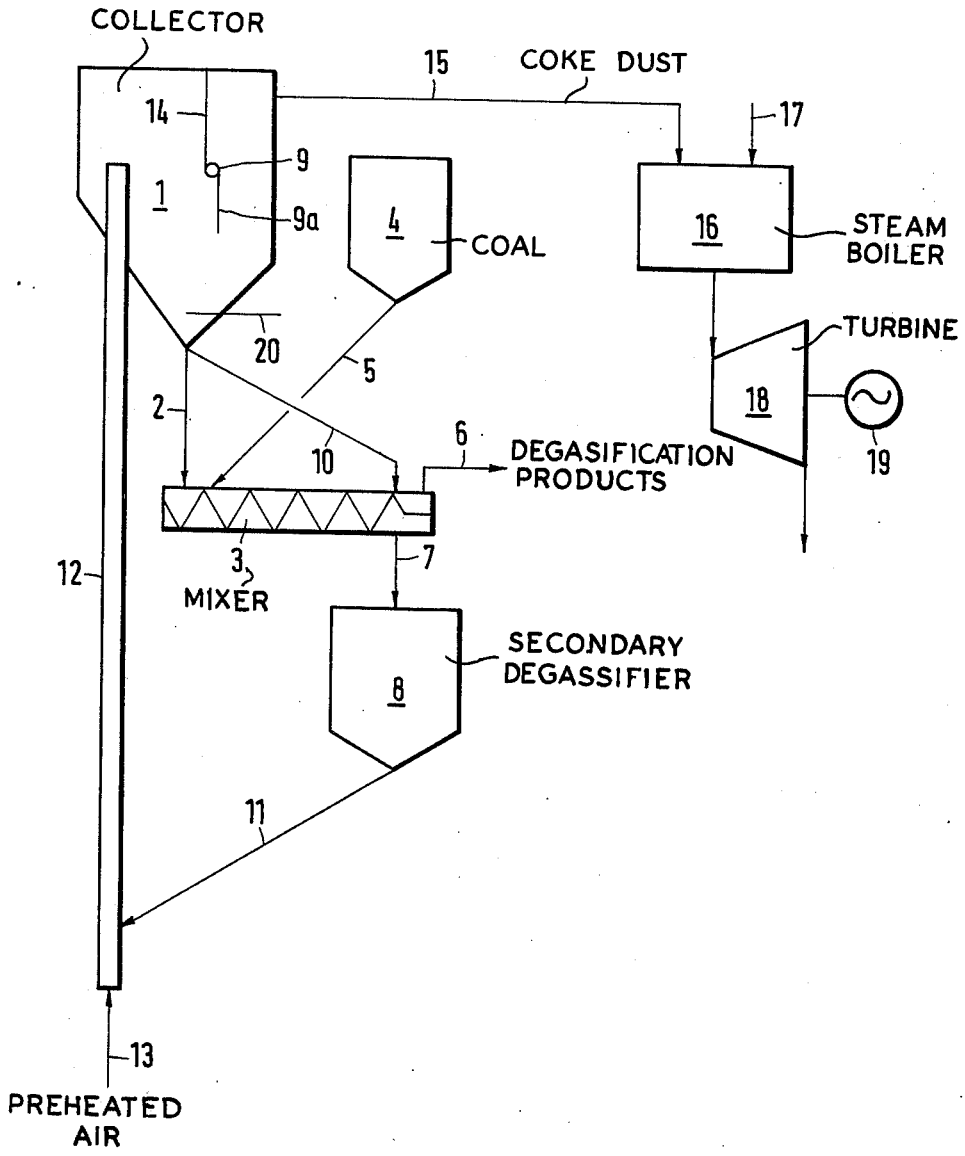
FIG. 1 is a diagram illustrating by way of example a first embodiment of the process and FIGS. 2 and 3 illustrate modifications of the process of FIG. 1.

In the process shown in FIG. 1, hot degasified residue flows as a heat-carrying medium from the collecting vessel 1 through conduit 2 into the mixer 3. In the vessel 1, the degasified residue is at a temperature between 600° C and 1,100° C, preferably between 800° and 1,100° C, care being taken that the temperatures are in any case below the softening temperature of the ash of the degasified residue. At the same time, fine-grained coal from the bin 4 is also fed into the mixer 3 through conduit 5. The mixer is preferably a double-shaft mixer having two shafts which rotate in the same sense. Such mixer is known per se, e.g., from U.S. Pat. No. 3,655,518.

In the mixer 3, the heat-carrying medium and the coal are intensely mixed with each other as they flow through a substantially horizontal mixing zone, in which the coal is heated to temperatures of about 550°–650° C and subjected to dry distillation. The gaseous and vaporous degasification products are withdrawn through conduit 6 and fed to dust-collecting and condensing means, which are not shown and known per se. A mixture of heat-carrying medium and newly formed, fine-grained, low-temperature coke is formed in the mixer 3 and flows through conduit 7 to a secondary degasification vessel 8.

In the embodiment shown in FIG. 1 that end of the mixter 3 in which the openings of conduits 6 and 7 are disposed is so designed that the mixing function ceases there and there is a sufficiently large free space for the outflow of the mixed solids and of the gaseous and vaporous degasification products. A partial stream of the degasified residue withdrawn from the collecting vessel 1 is fed through conduit 10 into that end portion of the mixer 3. The degasified residue from conduit 10 flows freely between the shafts of the mixer and together with the mixture produced in the mixer 3 and consisting of the heat-carrying medium and newly formed degasified residue flows through conduit 7 into vessel 8. This ensures a good distribution of the hot degasified residue from conduit 10 with the mixture produced in mixer 3. In the vessel 8, the hot solids from conduit 10 result in an additional temperature rise so that the low-temperature coke formed in the mixer 3 is subjected to a secondary degasification. The gaseous and vaporous secondary degasification products flow upwardly in conduit 7 and leave the mixer 3 also through conduit 6.

The solids contained in the secondary degasification vessel 8 flow continuously through conduit 11 to the lower end of the pneumatic conveyor line 12, which is fed with preferably preheated air under pressure from conduit 13 so that part of the coke from conduit 11 is burnt and the remaining coke is heated. In the conveyor line 12 the fine-grained solids are pneumatically elevated by the rising gases to enter the collecting vessel 1.

The vessel 1 contains a deflecting partition 14, which enforces a change of the direction of the conveying gases to ensure that degasified residue which is relatively coarse settles and is collected in the lower portion of the vessel 1. As a result, the solids entrained by the exhaust gas coming from the conveyor line 12 and flowing into the exhaust conduit 15 preferably constitute dust.

A plate 9*a* is hinged by a hinge 9 to the partition 14 and enables an adjustment of the cross-section of flow between the partition 14 and that wall of the vessel 1 from which the conduit 15 extends. In this way, the conditions which are desirable for the pneumatic separation to be effected by the flowing gases can be adjusted.

Instead of the provision of a hinged plate 9*a*, the lower portion of the partition 14 may consist of a one-part or composite ceramic shutter, which is adjustable vertically, i.e. in height. Other means for adjusting the cross-section of flow in the vessel 1 comprise a deflecting partition 14 formed with one or more vertical slots and vertically adjustable plates which extend over said slots. The total width of said slots may be up to two-thirds of the width of the deflecting partition.

To intensify the pneumatic separation of coke dust from the collecting vessel 1 and to minimize the dust content of the heat-carrying medium fed to the degasification spaces, a gaseous or vaporous pneumatic separating fluid may be fed into the lower portion of vessel 1, as is indicated in FIG. 1 in a simplified manner by the conduit 20. The feeding of such pneumatic separating gas through a plurality of nozzles into the collecting vessel is known from U.S. Pat. No. 3,703,442. The pneumatic separating gas together with the conveying gas from the conveyor line 12 carries the hot coke dust into conduit 15. Instead of or in combination with the pneumatic separating gas flowing through conduit 20, inert pneumatic separating gas may be fed into conduit 2, although this practice is not shown in the drawing.

In the conduit 15, coke dust which has been discharged from the collecting vessel 1 together with the hot combustion gases is fed as fuel to a steam boiler furnace 16 which is to be fed with powderized fuel and in which the coke is burnt together with air from conduit 17 for the generation of supurheated steam for driving a steam turbine 18. The turbine 18 is coupled to a generator 19 for generating electric power. The elements 16 to 19 represent a power plant process, known per se, in a highly simplified manner.

To obtain a strong grinding action, degasified residue may be fed at a high rate through conduits 10 and 7 directly to the secondary degasification vessel 8. In this case the conveyor gas in the conveyor line 12 may be laden with solids in an undesirably high degree. A corresponding increase of the air rate from conduit 13 would result in an excessive temperature rise of the degasified residue. In that case it is recommeded to dilute the conveying air by an admixing of water vapor or flue gas, which may be taken, e.g., from the power plant process and is fed to line 12 at its lower end. For the sake of clearness, however, a line which leads from the power plant process to the lower end of the conveyor line 12 has been ommited in FIG. 1.

Figure 2:
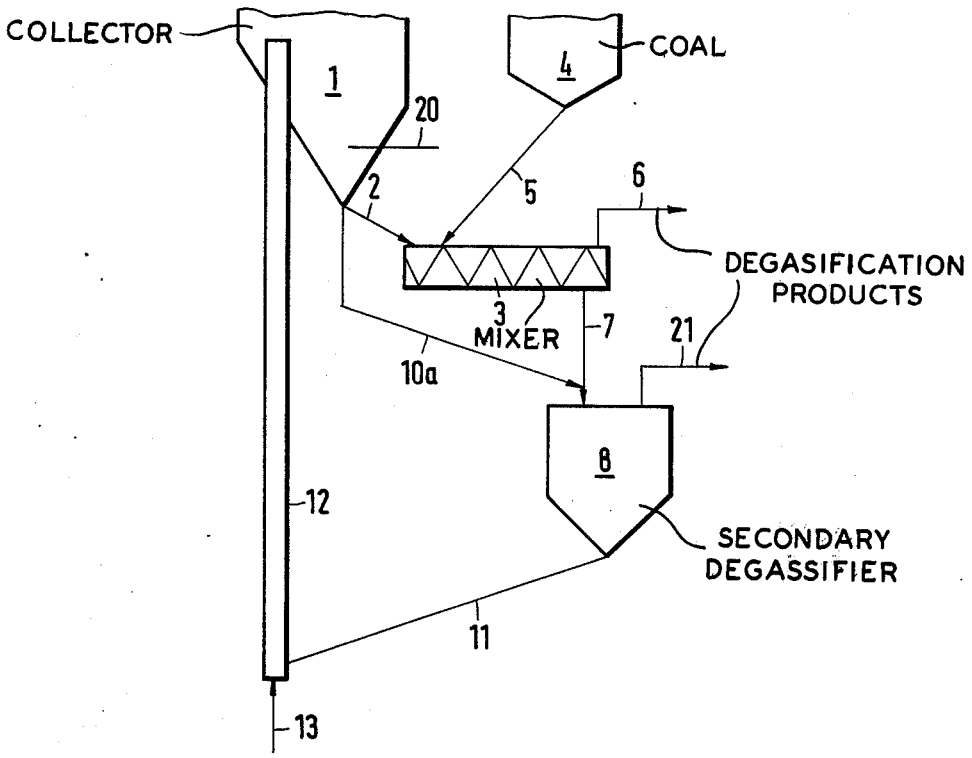
Figure 3:
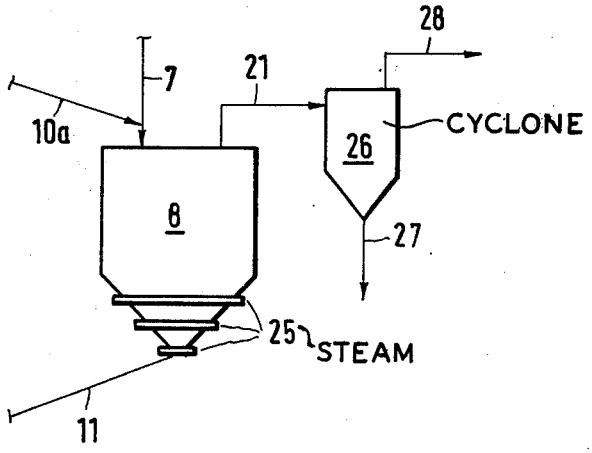

FIGS. 2 and 3 show modifications of the process of FIG. 1. The same reference characters have been used in FIGS. 1 to 3 to designate structurally or functionally identical parts of the process. For this reason, reference to FIG. 1 is made for detailed explanations.

In the modification of the process shown in FIG. 2 that partial stream of the degasified residue which has been branched off from the collecting vessel 1 is fed through conduit 10*a* to the mixed solids which flow through conduit 7 from the mixer 3. The distribution of the solids in each other may be accomplished, e.g., by a ring-chamber distributor, which is provided on conduit 7. Such distributors are known, e.g., from Printed German Application No. 1,809,874. The secondary degasification in vessel 8 produces gaseous and vaporous degasification products, which are discharged through conduit 21. In this modification of the process, the high-tar gases produced by dry distillation and leaving the mixer 3 through conduit 6 may be further processed separately from the gases which have been produced in vessel 8 and which will be free from tar if sufficiently high temperatures are maintained in the mixer. In the process according to FIG. 2, care is taken that the volume rates at which gas and vapor are withdrawn through conduits 6 and 21 correspond to the volume rates at which gases and vapors become available in the mixer 3 and vessel 8, respectively. The gas pressure maintained in vessel 8 is preferably slightly higher than in the mixer 3. To improve the separation of the two different gases, the conduit 7 may include an equilibrium barrier, which automatically controls itself in such a manner that the differential gas pressure between the vessel 8 and the mixer 3 carries a sufficiently high column of solids in conduit 7.

When the conduit 10*a* is mounted on the vessel 1 on a higher lever than conduit 2, an equilibrium barrier in conduit 10*a* will greatly facilitate the operation of the plant because a constant solids level will automatically be maintained in the collecting vessel 1.

FIG. 3 illustrates a modification of the process explained with reference to FIG. 2. For this reason, parts which are identical to those shown in FIG. 2 are ommited in FIG. 3. In accordance with FIG. 3, a pneumatic separating fluid is fed into the secondary degasification vessel 8 and serves to entrain degasified residue dust.

This degasified residue flows through conduit 21 to a cyclone 26 (or a plurality of cyclones) and becomes available in conduit 27 as a hot fuel for boiler furnaces. The gas which has been freed from the coke dust is withdrawn through conduit 28.

It is possible and suitable to use water vapor as a pneumatic separating fluid, which is fed through a plurality of annular conduits 25, which surround the conical lower portion of the vessel 8 and are connected by stub lines to the vessel 8. In this way the water vapor can be fed into the vessel in a fairly uniform distribution over the cross-section of the vessel. The presence of the water vapor initiates gasification reactions in the hot coke so that the quantity of product gas which leaves the vessel 8 can be increased. The water vapor may be produced by means of the waste heat which becomes available in the system, e.g., during the condensation of tar.

The removal of the degasification residue dust from the secondary degasification vessel by pneumatic separation affords the advantage that the average particle size of the solids flowing through conduit 11 to the conveyor line 12 is increased. Whereas coke dust would normally be preferentially burnt in the conveyor line 12, this coke dust has now been removed from the degasification residue and can be used as a fuel at another point. This measure will also increase the reduction in size of the solids in the conveyor line by abrasion. The pneumatic separation in the secondary degasification vessel may entirely or largely replace the pneumatic separation effected in the collecting vessel by means of the conduit 20 (FIG. 1).

Various details of the processes illustrated in FIGS. 1 to 3 have not been explained but will become readily apparent to a person skilled in the art. For instance, shutoff valves and metering means must be incorporated in the conduits 10 and 10*a* for the degasification residue which has been branched off and may consist of gate valves or star feeders for metering the rates of the branched-off streams. This applies also to conduits 2 and 11, in which the flow of solids must be controlled too. The column of fine-grained solids building up over these control means is also a barrier for preventing undesired gas streams. For an automatic control of the solids flow it may be desirable in some cases to provide a so-called equilibrium barrier, which comprises a solids column carried by the differential gas pressure between the vessels connected to said zone.

Whereas in the process embodiments shown in FIGS. 1 and 2, the mixing zone for mixing the hot heat-carrying medium and the relatively cold fuel consists of a mechanical mixer 3, it is not essential to use a mechanical mixer unless the solids to be mixed tend to cake. With non-caking solids, the hot and cold solids may be conducted one into the other and into a dry distillation vessel in such a manner that a highly homogeneous distribution of one component in the other is obtained in said vessel. Such mixing of hot heat-carrying medium and fuel is described, e.g., in the German Pat. No. 1,909,263.

Specifically, the process embodiments shown in FIGS. 2 and 3 may be modified in that the conduit 7 which connects the dry distillation zone and the secondary degasification zone is interrupted by a buffer vessel. The bulk material contained in said buffer vessel or in an outlet conduit constitutes a gastight barrier between the dry distillation zone and the succeeding secondary degasification zone proper (vessel 8).

To produce a mixture, e.g., in the mixing and dry distillation zone or in the secondary degasification zone, it may be desirable to use a process which is known from U.S. Pat. No. 3,136,705 and in which the fine-grained solids to be admixed are added to the other fine-grained solids while the latter are being agitated or fluidized. A homogeneous mixture can be produced in that way in short residence times. That apparatus is suitable for feeding solids which tend to cake.

EXAMPLE 1

In a process as shown in FIG. 1, fine-grained coke at about 850° C is withdrawn from the collecting vessel 1 at a rate of 1,000 tons per hour. One-half of these solids flows through each of conduits 2 and 10. Fine-grained hard coal in a particle size mainly below 3 mm is fed at a rate of 140 tons per hour through conduit 5 into the mixer 3 and is mixed therein with the heat-carrying medium from conduit 2 to produce a mixture which is at a temperatue of about 600° C. Heat-carrying medium from conduit 10 is added to said mixture to increase its temperature to about 720° C. The mixture is further degasified in the vessel 8. The material from the secondary degasification vessel 8 is heated further to about 850° C in the pneumatic conveyor line 12 by an addition of air and is fed into the collecting vessel 1. The flow conditions in the collecting vessel 1 are so adjusted that coke is discharged at a rate of about 70 tons per hour through conduit 15 without need for additional pneumatic separating gas. The coke dust in conduit 15 is used as a fuel in a steam power plant. The remaining coke produced by the degasification of the feed coal is collected as dust in a cyclone from the distilled-off gas flowing in conduit 6 and is also fed, preferably pneumatically, to the furnace of the steam boiler.

If the proportion of the heat-carrying medium which is recirculated would be reduced, e.g., to 75% so that the ratio of the solids flow rates in conduits 2 and 10 would be 1:0.5, whereas the same temperatures are maintained in the mixer, coke dust would be removed only at a rate of about 40 tons per hour from the circulation system for the heat-carrying fluid by the flue gases in conduit 15. The surplus would have to be withdrawn as granular solids and would not be sufficiently fine for direct use at a boiler furnace to be fired with pulverized fuel.

EXAMPLE 2

In a process according to FIG. 2, highly volatile predried hard coal having an upper particle size limit of 5mm is degasified at a rate of 200 tons per hour. Fine-grained coke at a temperature of 950° C is continuously fed at a rate of 700 tons per hour from the collecting vessel 1 through conduit 2 into the mixer 3, in which a mixture of the heat-carrying medium and newly formed degasification residue is formed. At the discharge end of the mixer this mixture has a temperature of 650° C through conduit 7 into the secondary degasification vessel 8. Also at a temperature of about 650° C, the gaseous and vaporous degasification products having a high tar content are withdrawn from the mixer through conduit 6. Additional hot fine coke at 950° C is withdrawn through conduit 10*a* from vessel 1 at a rate of 1400 tons per hour and is added in a uniform distribution to the mixture from the mixer 3 by a ring-chamber distributor, which surrounds the conduit 7 above the secondary degasification vessel 8. This results in a secondary degasification temperature of 850° C in the vessel 8. The gases evolved by the secondary degasification are free of tar and are withdrawn through conduit 21 and subjected to dust collection and then to cooling and condensation, suitably separately from the tar-containing degasification products flowing in conduit 6. The fine coke in vessel 8 is at 850° C and is fed through conduit 11 to the conveyor line 12 and by being partly burnt is reheated to 950° C. A pneumatic separating fluid is fed through conduit 20 to vessel 1 and used to remove coke dust at a rate of 90 tons per hour by pneumatic separation and to carry said coke dust together with the hot exhaust gases to the steam boiler. The dusts which are collected from the product gases flowing in conduits 6 and 21 are sufficiently fine to be fired and are also fed to the boiler furnace without being cooled.

EXAMPLE 3

In a process as shown in FIG. 3, highly volatile, predried hard coal having an upper particle size limit of 5 mm is degasified at a rate of 200 tons per hour. Fine-grained coke at a temperature of 970° C is continuously fed at a rate of about 370 tons per hour from the collecting vessel 1 through conduit 2 into the mixer 3, in which a mixture of newly formed degasification residue and heat-carrying medium is produced. At the discharge end of the mixer this mixture has a temperature of 590° C. The mixture flows through conduit 7 into the secondary degasification vessel 8. The vaporous dry distillation products leaving the mixer through conduit 6 are also at a temperature of 590° C. The dust collected from the gas produced by dry distillation is fed into the secondary degasification vessel 8 because this dust contains too much coarse particles.

Additional hot coke is withdrawn at 970° C from the collecting vessel 1 through conduit 10*a* at a rate of about 3000 tons per hour and is fed to the secondary degasification vessel 8 through a ring-chamber distributor, which surrounds the conduit 7. The resulting mixture in the vessel 8 is at a temperature of about 910° C. Steam at a rate of about 10 tons per hour is injected into the vessel 8 from below through inlet pipes which are distributed on the cone of the vessel and are indicated by conduit 25.

The container 8 contains a bed consisting of hot mixed fine coke. This bed is flown through by the steam from bottom to top so that part of the coke is gasified with consumption of water vapor. The steam or residual steam and the gas produced by gasification act together with the gas produced by secondary degasification to increase the velocity of the gas from bottom to top from about 0.15 meter per second to 0.55 meter per second (calculated for the free cross-section of the vessel) so that the bed is subjected to pneumatic separation and coke having a particle size below 0.2 mm is discharged from container 8 through conduit 21 at a rate of about 75 tons per hour and is collected in series-connected cyclones 26 and pneumatically fed at about 910° C to the steam boiler.

The gas produced by secondary degasification, the gas produced by gasification, and the residual steam are free of tar and are fed in conduit 28 and subjected to fine dust collection separately from the degasification products flowing in conduit 6 when said gases have transferred a major portion of their sensible heat in heat exchangers to the air to be fed into the conveyor line 12 through conduit 13.

The coke in the vessel 8 is at about 910° C and is fed to the conveyor line 12 through conduit 11 and is reheated to 970° C and reduced in size by being partly burnt. When the coke from the conveyor line is collected in the collecting vessel 1, sufficiently fine-grained coke is removed by pneumatic separation and with the aid of the variable partition 14 at a rate of about 30 tons per hour from the material which has been reduced in size and the coke thus removed is fed to the steam boiler through conduit 15 together with the exhaust gases from the conveyor line. A pneumatic separating fluid is not required.

What is claimed is:

1. In a process for continuously degasifying fine-grained coal, wherein a fine-grained degasified residue is recirculated as a heat-carrying medium and is heated in a pneumatic conveyor line and then fed to a collecting vessel, the improvement which comprises feeding a first partial stream of the heat-carrying medium from said collecting vessel to a mixing zone together with said fine-grained coal for a dry distillation of said coal, feeding a second partial stream of the heat-carrying medium from said collecting vessel and the mixture of solids from said mixing zone to a separate degasification zone downstream from said mixing zone, withdrawing volatile products from the mixtures in the mixing zone and the degasification zone and feeding them to dust-collecting and condensing means, recirculating degasified residue from said degasification zone to the pneumatic conveyor line, maintaining the ratio of the rate of the second partial stream to the rate of the first partial stream of the heat-carrying medium between 0.2:1 and 15:1, and discharging degasified residue dust in a particle size of more than 75% below 0.3 mm from said collecting vessel.

2. Process of claim 1 wherein the second partial stream of the degasified residue is added at the end of the mixing zone of a mechanical mixer to the mixture which has been produced in the mixer.

3. Process of claim 1 wherein the second partial stream of the degasified residue is added to the mixture which contains the dry distillation residue by a ring-chamber distributor which surrounds the conduit for feeding the degasification zone downstream from said mixing zone.

4. Process of claim 1 wherein the second partial stream of the degasified residue is added to the mixture which contains the dry distillation residue by a plurality of injection conduits opening into the conduit for feeding the degasification zone.

5. Process of claim 1 wherein degasified residue dust having a particle zone of preferably more than 90% below 0.3 mm is discharged and used as fuel in one or more steam boiler furnaces.

6. Process of claim 1 wherein the degasification residue in the collecting vessel is at a temperature of 600°-1100° C.

7. Process of claim 1 wherein the mixture formed in the mixing zone is at a temperature in the range of 500°-750° C.

8. Process of claim 1 wherein the ratio of the rate of the second partial stream to the rate of the first partial stream of the degasified residue is between 0.3:1 and 10:1.

9. Process of claim 1 wherein hot degasified residue used as a heat-carrying medium and fuel to be degasified are mixed in the mixing zone at a weight ratio between 1:1 and 10:1.

10. Process of claim 1 wherein the gaseous and vaporous degasification products are withdrawn from the mixing zone.

11. Process of claim 1 wherein gaseous and vaporous degasification products from the mixing zone and gaseous and vaporous degasification products from the degasification vessel downstream from said mixing zone are separately conducted.

12. Process of claim 1 wherein degasified residue dust is removed at a metered rate by pneumatic separation.

13. Process of claim 1 wherein degasified residue dust is removed from the collecting vessel and/or the degasification zone downstream from said mixing zone at a metered rate by pneumatic separation.

14. Process of claim 12 wherein the removal of the degasified residue dust in the collecting vessel by pneumatic separation is controlled by a change of the cross-sections of flow in said vessel.

15. Process of claim 12 wherein the pneumatic separation in the collecting vessel is controlled by the feeding of gaseous or vaporous pneumatic separating fluids.

16. Process of claim 12 wherein water vapor is fed into a secondary degasification vessel for the pneumatic separation and partial gasification of degasified residue dust.

17. Process of claim 1 wherein a mixture of heatcarrying medium and newly formed degasified residue is produced in the mixing zone and is fed to a first degasification vessel, the gaseous and vaporous degasification products are removed through a first conduit, solids from the first degasification vessel downstream from said mixing zone are fed to a second degasification vessel downstream from said mixing zone having a separate exhaust conduit, and the second partial stream of the degasified residue is branched off from the collecting vessel and also fed to the second degasification vessel downstream from said mixing zone.

18. Process of claim 1 wherein the solids flow rates in the conduits for the first and second partial streams of the degasified residue are adjusted by means of gate valves, star feeders or the like metering means.

19. Process of claim 1 wherein flue gas or water vapor is fed into the pneumatic conveyor line.

20. Process of claim 1 wherein the socond partial stream of the degasified residue and the solids from the mixing zone are fed to a zone in which the solids are fluidized in the degasification vessel downstream from said mixing zone.

21. Process of claim 1 wherein the column of fine-grained solids between two vessels constitutes an equilibrium barrier, the height of which is controlled by the differential gas pressure between the two vessels.

22. Process of claim 1 wherein the pneumatic separating fluid, particularly water vapor, is fed to the degasified residue by a plurality of annular conduits which surround the conical portion of the vessel and are provided with stub conduits leading into the vessel at different locations.

23. Process of claim 1 wherein the second partial stream of the degasified residue is withdrawn from the collecting vessel on a higher level than the first partial stream.

24. Process of claim 1 wherein the degasification residue in the collecting vessel is at a temperature of 800°-1000° C.

25. Process of claim 7, wherein the mixture formed in the mixing zone is at a temperature in the range of 550°-650° C.

26. Process of claim 9 wherein hot degasified residue used as a heat-carrying medium and fuel to be degasified are mixed in the mixing zone at a weight ratio between 1.5:1 and 4:1.

* * * * *